United States Patent [19]

Keller et al.

[11] 4,277,247

[45] Jul. 7, 1981

[54] PROCESS FOR DYEING PRE-CLEANED CELLULOSE FIBER MATERIAL

[75] Inventors: Karlheinz Keller, Bettingen; Lotti Furer, Biel, both of Switzerland

[73] Assignee: Ciba-Geigy Corporation, Ardsley, N.Y.

[21] Appl. No.: 108,270

[22] Filed: Dec. 31, 1979

[30] Foreign Application Priority Data

Jan. 10, 1979 [CH] Switzerland ..... 217/79

[51] Int. Cl.[3] ..... C09B 67/00

[52] U.S. Cl. ..... 8/557; 8/650; 8/680; 8/908; 8/918; 8/931

[58] Field of Search ..... 8/557, 650, 680, 908, 8/918

[56] References Cited

U.S. PATENT DOCUMENTS

| | | | |
|---|---|---|---|
| 3,940,247 | 2/1976 | Sthare et al. | 8/602 |
| 4,036,587 | 7/1977 | Wolf et al. | 8/582 |
| 4,055,393 | 10/1977 | Schafer et al. | 8/445 |
| 4,071,468 | 1/1978 | Abel et al. | 8/584 |
| 4,092,266 | 5/1978 | Abel et al. | 8/584 |

*Primary Examiner*—A. Lionel Clingman

*Attorney, Agent, or Firm*—Edward McC. Roberts

[57] ABSTRACT

A dyeing process for improving the levelness of cellulose dyeings with vat dyes or anionic dyes and for preventing creases in the dyed goods, wherein the process according to the invention comprises dyeing the cellulose fiber material in the presence of a polypropylene oxide adduct, or a salt thereof, which adduct contains carboxyl groups and has been prepared from (a) an aliphatic diol which has an average molecular weight of not more than 2,600, (b) an aliphatic dicarboxylic acid, or its anhydride, having 4 to 10 carbon atoms, (c) an adduct of propylene oxide with an aliphatic alcohol which is at least trihydric and has 3 to 10 carbon atoms and (d) a fatty acid having 8 to 22 carbon atoms.

15 Claims, No Drawings

PROCESS FOR DYEING PRE-CLEANED CELLULOSE FIBER MATERIAL

The present invention relates to a novel process for dyeing pre-cleaned cellulose fibre material with vat dyes or anionic dyes and to the cellulose material dyed by means of this process.

The process according to the invention comprises dyeing the cellulose material in the presence of a polypropylene oxide adduct, or of a salt thereof, which adduct contains carboxyl groups and has been prepared from (a) an aliphatic diol which has an average molecular weight of not more than 2,600, (b) an aliphatic dicarboxylic acid, or its anhydride, having 4 to 10 carbon atoms, (c) an adduct of propylene oxide with an aliphatic alcohol which is at least trihydric and has 3 to 10 carbon atoms and (d) a fatty acid having 8 to 22 carbon atoms.

The polypropylene oxide adducts can be in the form of the free acids or in the form of salts, for example alkali metal salts or ammonium salts. Alkali metal salts are in particular the sodium and potassium salts, and ammonium salts are in particular the ammonium, trimethylammonium, monoethanolammonium, diethanolammonium and triethanolammonium salts.

The sodium salts or ammonium($NH_4$) salts are preferred.

Preferably, the polypropylene oxide adduct containing carboxyl groups is built up from 1 to 3 mols, preferably 1 mol, of component (a), 2 to 4 mols, preferably 2 mols, of component (b), 1 mol of component (c) and 1 to 2 mols of component (d).

Component (a) is preferably a diol of the formula $$HO-(CH_2-CH_2-O)_n-H \quad (1)$$

in which n is 1 to 50 and preferably 10 to 40. Examples of such diols are ethylene glycol, diethylene glycol or polyethylene glycols with an average molecular weight of 450 to 2,300 and especially 650 to 1,800. Further aliphatic diols can also be 1,3- or 1,2-propylene glycol or 1,5-pentanediol.

The aliphatic dicarboxylic acids of component (b) can be saturated or ethylenically unsaturated. Examples of suitable aliphatic, saturated dicarboxylic acids are succinic acid, glutaric acid, adipic acid, pimelic acid, suberic acid, aelaic acid or sebacic acid, or their anhydrides, especially succinic anhydride or glutaric anhydride.

Ethylenically unsaturated dicarboxylic acids are preferably fumaric acid, maleic acid or itaconic acid, and also mesaconic acid, citraconic acid and methylenemalonic acid. A suitable anhydride of these acids is in particular maleic anhydride, and this is also the preferred component (b).

Component (c) is in particular an adduct of propylene oxide with a trihydric to hexahydric alkanol having 3 to 6 carbon atoms. These alkanols can be straightchain or branched. Examples are glycerol, trimethylolpropane, erythritol, pentaerythritol, mannitol or sorbitol.

The reaction products of component (c) can be prepared, for example, by adding about 2 to 20 mols, and preferably 4 to 12 mols, of propylene oxide onto 1 mol of the trihydric to hexahydric alcohol.

Adducts of 4 to 8 mols of propylene oxide with 1 mol of pentaerythritol have proved particularly suitable.

The fatty acids of component (d) are saturated or unsaturated acids, for example caprylic acid, capric acid, lauric acid, myristic acid, palmitic acid, stearic acid, arachic acid, ($C_{10}$–$C_{16}$)-coconut fatty acid, behenic acid, decenoic acid, dodecenoic acid, tetradecenoic acid, hexadecenoic acid, oleic acid, linoleic acid, linolenic acid, ricinoleic acid, eicosenoic acid, docosenoic acid or clupanodonic acid.

Oleic acid, coconut fatty acid, tallow fatty acid, palmitic acid or, in particular, stearic acid are of primary interest.

Preferred polypropylene oxide adducts are obtained from the following components: ($a_1$) an aliphatic diol of the formula (2)

$$HO-(CH_2CH_2O)_{n_1}H$$

in which $n_1$ is 10 to 40, preferably polyethylene glycols with an average molecular weight of 900 to 1,800 and especially 1,500–1,600, ($b_1$) a saturated or ethylenically unsaturated aliphatic dicarboxylic acid, or its anhydride, having 4 to 10 carbon atoms, especially maleic anhydride, ($c_1$) an adduct of propylene oxide with trihydric to hexahydric alcanols having 3 to 6 carbon atoms and ($d_1$) a saturated or unsaturated fatty acid having 12 to 22 carbon atoms, especially coconut fatty acid, oleic acid, palmitic acid and in particular stearic acid.

The polypropylene oxide adducts are in particular used as levelling agents and anticrease agents when dyeing cellulose materials with vat dyes or reactive dyes.

The amounts in which the polypropylene oxide adducts are added to the dye liquor vary (based on their solids content) between 0.05 and 3 g and preferably 0.3 and 1 per liter of liquor.

Typical representatives of these adducts are reaction products of 1. 1 mol of the condensation product of 1 mol of pentaerythritol and 4 to 8 mols of propylene oxide, with 2 mols of maleic anhydride, 1 mol of diethylene glycol and 1 mol of coconut fatty acid,
2. 1 mol of the condensation product of 1 mol of pentaerythritol and 4 to 8 mols of propylene oxide, with 2 mols of maleic anhydride, 1 mol of polyethylene glycol with an average molecular weight of 1,500 and 1 mol of stearic acid,
3. 1 mol of the condensation product of 1 mol of pentaerythritol and 4 to 8 mols of propylene oxide, with 2 mols of glutaric anhydride or succinic anhydride, 1 mol of polyethylene glycol with an average molecular weight of 1,500 and 1 mol of coconut fatty acid,
4. 1 mol of the condensation product of 1 mol of pentaerythritol and 4 to 8 mols of propylene oxide, with 2 mols of maleic anhydride, 1 mol of polyethylene glycol with an average molecular weight of 900 and 1 mol of stearic acid, and
5. 1 mol of the condensation product of 1 mol of pentaerythritol and 8 mols of propylene oxide, with 2 mols of maleic anhydride, 1 mol of polyethylene glycol with an average molecular weight of 1,500 and 1 mol of oleic acid or palmitic acid.

Adducts 1 to 5 can be in the form of the free acids or in the form of salts, especially in the form of the sodium salts or ammonium salts.

The polypropylene oxide adducts are prepared by known methods. One process for the preparation of these products comprises reacting component (a) with components (b), (c) and (d) and, if desired, converting the product into a salt. The reaction of component (a)

with components (b), (c) and (d) is carried out at temperatures of 80° C. to 150° C. and preferably of 90° C. to 130° C., if desired in the presence of an acid catalyst and/or of an organic solvent which is inert towards the reactants. The catalyst used can be, for example, sulfuric acid or p-toluenesulfonic acid. Suitable organic solvents are, for example, benzene, toluene or xylene.

When dicarboxylic acids are used as component (b), the various components can be reacted at the same time. If anhydrides of aliphatic dicarboxylic acids are employed as component (b), the esterification is advantageously carried out stepwise. In a first step, for example, the diol (component a) is reacted in the presence of a polymerisation inhibitor, for example di-(tert.-butyl)-p-cresol, with the anhydride by warming to 90° to 130° C. to give the bis-monoester of the dicarboxylic acid, and this acid is then further esterified, in a second step, with the addition of an acid catalyst and if desired in the presence of an inert organic solvent, for example benzene or toluene, with the adduct of component (c) and a fatty acid (component d) at 90° to 130° C., after which the ester product, which still contains carboxyl groups, can be converted into a salt by the addition of bases, such as ammonia or alkali metal hydroxides. Depending on their composition, the resulting adducts are solid to liquid, highly viscous products. They can therefore be in the form of waxes, pastes or oils and as a rule are colourless or slightly yellow or brown coloured.

Suitable cellulose material is material of natural or regenerated cellulose, for example hemp, linen, jute, viscose rayon, rayon staple, cellulose acetate and in particular cotton, and also fibre blends, for example those of polyester/cotton, in which case the polyester in the blend is dyed, beforehand, at the same time or subsequently, with disperse dyes. The cellulose material can be in very diverse stages of processing, for example in the form of loose material, yarn, woven fabrics or knitted fabrics. It has been pre-cleaned, that is to say has been pre-treated ready for dyeing, for example by boiling in an acid range or in particular in an alkaline range.

The vat dyes are higher fused and heterocyclic benzoquinones or naphthoquinones, sulfur dyes and in particular anthraquinonoid or indigoid dyes. Examples of vat dyes which can be used according to the invention are listed in the Colour Index, 3rd Edition (1971), Volume 3 on pages 3,649 to 3,837 under the heading "Sulfur Dyes" and "Vat Dyes."

The anionic dyes are in particular the substantive dyes, leuco vat esters or in particular reactive dyes which can be used for cellulose materials.

Suitable substantive dyes are the customary direct dyes, for example the "Direct Dyes" listed on pages 2,005–2,478 in the Colour Index, 3rd Edition, (1971), Volume 2.

The leuco vat esters are, for example, obtainable from vat dyes of the indigo, anthraquinone or indanthrene series by reduction, for example with iron powder, and subsequent esterification, for example with chlorosulfonic acid, and in the Colour Index, 3rd Edition, 1971, Volume 3 are termed "Solubilised Vat Dyes."

Reactive dyes are understood as meaning the customary dyes which enter into a chemical bond with the cellulose, for example the "Reactive Dyes" listed on pages 3,391–3,560 of the Colour Index, 3rd Edition (1971), Volume 3.

The amount of dyes added to the dye liquor depends on the desired depth of colour. In general, amounts of 0.01 to 10 and preferably 0.01 to 3 percent by weight, based on the cellulose material employed, have proved suitable.

Depending on the dye to be used, the dye liquors can contain further customary additives, in addition to the polypropylene oxide adduct mentioned as the levelling agent, for example alkali, such as sodium carbonate, sodium bicarbonate, sodium hydroxide or aqueous ammonia, or alkali donors, for example sodium trichloroacetate, and also hydrosulfite or electrolytes, for example sodium chloride or sodium sulfate. Sequestering agents, on the other hand, are not required. The pH value of the dye liquors is as a rule 6 to 12.5 and preferably 8 to 12.

The dyeings are advantageously carried out from an aqueous liquor by the exhaustion process. The liquor ratio is dependent on the different parameters of the apparatus, on the substrate and on the type of material. However, it can be chosen within a wide range, for example 1:4 to 1:100, but in most cases is between 1:5 and 1:40.

The process according to the invention can be carried out at temperatures of 20° to 135° C. If the material to be dyed is solely cellulose material, dyeing is advantageously carried out at a temperature of 20° to 106° C. and preferably of 30° to 95° C.

Dyeings on polyester/cotton fibre materials are preferably carried out at temperatures above 106° C. and advantageously at 110° to 135° C. These mixed fibre materials can be dyed in the presence of carriers or carrier mixtures, which act as dyeing accelerators for dyeing the polyester in the material with disperse dyes.

The dyeing process can be carried out either by first briefly treating the material to be dyed with the polypropylene oxide adduct and then dyeing or, preferably, by treating the material to be dyed with the adduct and with the dye at the same time.

After dyeing, the dyed cellulose material can be washed in a conventional manner, in order to remove dye which has not been fixed. For this purpose, the substrate is treated, for example at 40° C. up to the boil, in a solution which contains soap or synthetic detergent.

Level and strong dyeings which are distinguished by good dye yields are obtained by the dyeing process according to the invention. In particular, level dyeings are obtained and the cellulose material is crease-free, has perfect levelness and possesses a pleasant, soft handle.

Moreover, the use of the polypropylene oxide adduct has no adverse influence on the fastness properties of the dyeings, for example the fastness to light, fastness to rubbing and the wet fastness properties. Furthermore, troublesome foaming does not arise when the cellulose material is dyed in the presence of the polypropylene oxide adduct used according to the invention.

In the following methods of preparation and examples, the percentages are by weight, unless indicated otherwise. The amounts are based on the commercially available product in the case of the dyes, that is to say on the diluted product, and on the pure substance in the case of the adduct. The five-figure Colour Index numbers (C.I.) refer to the 3rd edition of the Colour Index.

METHODS OF PREPARATION

Method A 150 g of polyethylene glycol with an average molecular weight of 1,500, 19.6 g of maleic anhydride and 0.3 g of di-(tert.-butyl)-p-cresol are heated to 130° C. and the mixture is kept at 130° C. for 3 hours, with stirring. The reflux condenser is replaced by a receiver, 60 g of a condensation product of 1 mol of pentaerythritol and 8 mols of propylene oxide, 22 g of stearic acid and 0.5 g of 98% sulfuric acid are added and the mixture is kept at 130° C. for a further 5 hours in vacuo, during which time small amounts of water are distilled off. The melt is cooled to about 60° C., 2 g of a 30% sodium hydroxide solution are added, in order to neutralise the sulfuric acid, and an ester condensation product with an acid number of 7 is obtained. The condensation product is dissolved in 580 g of water and, in order to stabilise the solution, the pH is adjusted to 6.5–7.0 by adding 30% sodium hydroxide solution. A 30% viscous solution of the polypropylene oxide adduct is obtained.

Method B

The procedure of Method A is repeated, except that 10.6 g of diethylene glycol are used in place of 150 g of polyethylene glycol 1,500, and 15.6 g of coconut fatty acid are used in place of 22 g of stearic acid. A 30% viscous emulsion of the polypropylene oxide adduct containing carboxyl groups is obtained.

Method C

The procedure of Method A is repeated, except that 20 g of succinic anhydride are used in place of 19.6 g of maleic anhydride, and 15.6 g of coconut fatty acid are used in place of 22 g of stearic acid. A 30% viscous solution of the polypropylene oxide adduct is obtained.

Method D

The procedure of Method A is repeated, except that 100 g of polyethylene glycol with an average molecular weight of 1,000 are used in place of 150 g of polyethylene glycol 1,500. A 30% viscous solution of the polypropylene oxide adduct is obtained.

Method E

The procedure of Method A is repeated, except that 21.8 g of oleic acid are used in place of 22 g of stearic acid. A 30% viscous solution of the polypropylene oxide adduct is obtained.

EXAMPLE 1

In a circulation apparatus, 70 g of cotton, pre-treated ready for dyeing, are wetted in 500 ml of water. The following additives are then added to the liquor: 1.5 g of the product (30%) prepared according to Method A, 10 ml of 30% sodium hydroxide solution, 4 g of 86% hydrosulfite and 0.5 g of a vat dye consisting of Vat Blue 4 C.I. 69,800 and Vat Blue 6 C.I. 69,825 (1:3), which has been pre-dispersed with water and 5 ml of a 30% sodium hydroxide solution.

After uniform dispersion, the dye liquor is warmed to 60° C. in the course of 30 minutes and the cotton is dyed for 30 minutes at this temperature. 3 g of sodium chloride are then added to the dye liquor, after which the cotton is dyed for a further 30 minutes at 60° C. The dyed goods are then rinsed, warm and cold, and dried. A level and fast blue dyeing is obtained. The yarn has a pleasantly soft handle.

When the same dyeing procedure is repeated but without the addition of the product prepared according to Method A, the dyeing is less uniform, especially at the points where the yarns cross, and, in addition, the dyed material has a harder handle.

EXAMPLE 2

100 kg of cotton tricot (pre-treated ready for dyeing) are wetted, on a closed winch, in 2,500 l of water at 30° C. with the addition of 2,500 g of the product prepared according to Method A. 40 l of 30% sodium hydroxide solution and 10 kg of 86% hydrosulfite are then added to the liquor. The following stock vat is then added to the dyebath: 75 l of water, 2,500 g of 86% hydrosulfite, 6 l of 30% sodium hydroxide solution, 1,000 g of the vat dye Vat Yellow 2 C.I. 67,300 and 500 g of the vat dye Vat Violet 9 C.I. 60,005. The dye liquor is then warmed to 70° C. in the course of 30 minutes and the cotton is dyed for 30 minutes at this temperature. The dyed material is then rinsed and oxidised in running cold water. After drying, a level, solid dyeing results. The tricot is crease-free and has a pleasant soft handle.

EXAMPLE 3

100 kg of cotton tricot are wetted, on a short liquor jet, in 500 l of water at 20° C. 1,000 g of the product prepared according to Method A, diluted with water, are then added. 1,800 g of a dye of the formula

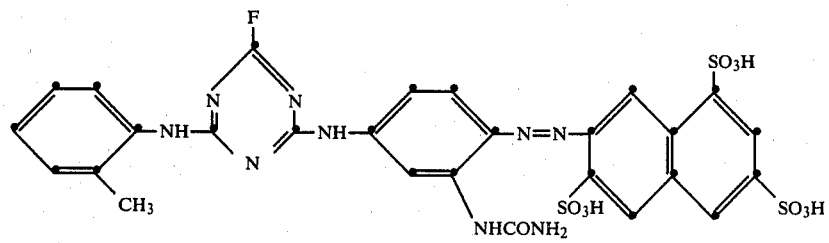

(101)

and 200 g of a dye of the formula

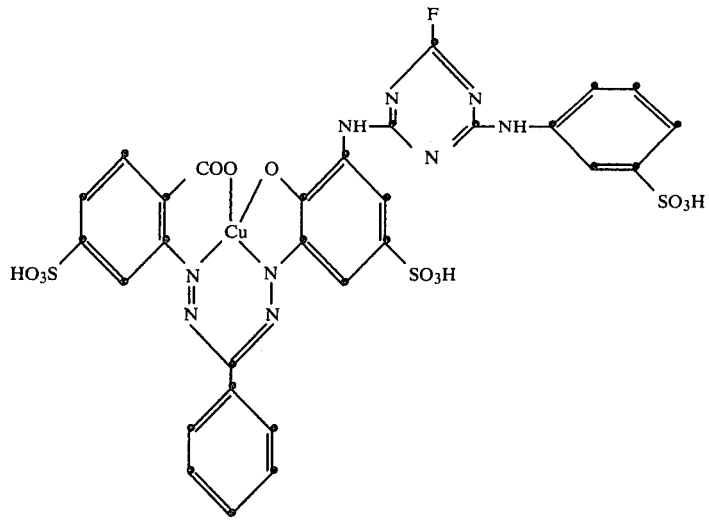

(102)

are then added in the form of a solution to the liquor. The temperature is raised to 30° C. in the course of 10 minutes. 10 kg of calcined sodium sulfate are then added and the temperature is raised to 40° C. in the course of 10 minutes, after which a further 10 kg of sodium sulfate are added. 500 g of calcined sodium carbonate are then added and after 5 minutes 1,000 ml of sodium hydroxide solution (30%) are added. Dyeing is then carried out for a further 30 minutes at 40° C. The dyebath is cooled and the dyed tricot is rinsed. This is then washed cold for 20 minutes and soaped for 20 minutes at the boil, after which it is again washed with hot and cold water. After drying, a level olive dyeing results. The tricot is crease-free and has a pleasant handle. When dyeing is carried out in the same way but without the product obtained according to Method A, the tricot not only shows creases but also displays unlevel results and has a harder handle.

EXAMPLE 4

100 kg of cotton tricot are wetted, in a short liquor jet, at 75° C. in 600 l of water with the addition of 600 g of the product (30% ) prepared according to Method A. The following additives are then added successively, each in the form of a good solution, to the dyebath: 1,500 g of a dye of the formula

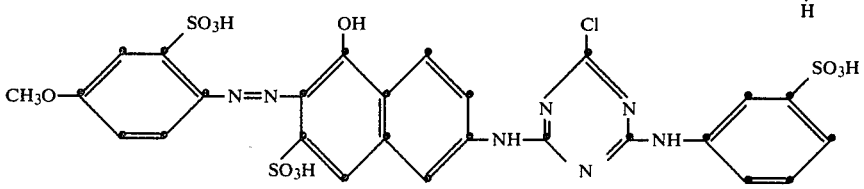

36,000 g of sodium chloride and 600 g of nitrobenzenesulfonic acid (Na salt).

The cotton tricot is then dyed at 75° C. for 30 minutes. 12,000 g of calcined sodium carbonate and 1,800 ml of sodium hydroxide solution (30%) are then added and the goods to be dyed are dyed for a further 60 minutes at 75° C. After cooling, the dyed goods are rinsed, soaped at the boil for 20 minutes and finally rinsed warm and cold.

After drying, a level, fast dyeing results. The knitted fabric has no creases and has a pleasant soft handle.

When the same procedure is repeated but without the addition of the product prepared according to Method A, the dyeing is less uniform and, moreover, the dyed material has a harder handle.

EXAMPLE 5

100 kg of knit-fabric of 66% polyester fibres and 34% cotton are wetted, on a HT winch, in 3,000 l of water at 50° C., with the addition of 3 kg of a condensation product of naphthalenesulfonic acid and formaldehyde, 1 kg of the polypropylene oxide adduct prepared according to Method A and 6 kg of ammonium sulfate, after which the pH of the liquor is adjusted to 5.5 with formic acid. 700 g of a disperse dye of the formula

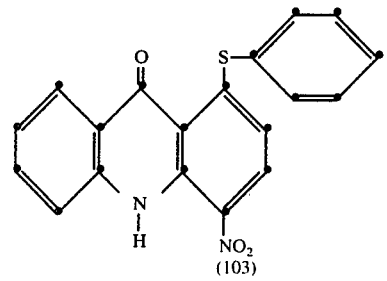

(104)

(103)

and 800 g of a direct dye of the formula

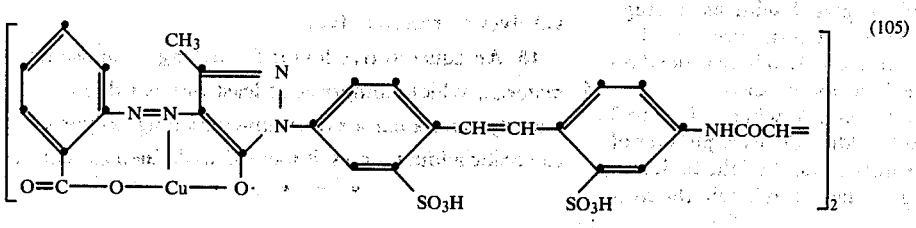

(105)

are then added to the liquor. The dye liquor is heated to 125° C. in the course of 40 minutes and the goods are dyed for 60 minutes at this temperature. The dye liquor is then cooled to 95° C. and 15 kg of anhydrous sodium sulfate are added, after which the knit-fabric is dyed for a further 50 minutes at 95° C. The liquor is then cooled and the dyed goods are rinsed and dried.

A level dyeing is obtained and the cotton and the polyester are dyed in virtually the same shade and with virtually the same depth of shade. The handle of the goods is pleasantly soft and the knit-fabric has no creases.

EXAMPLE 6

100 kg of cotton tricot are wetted, on a short liquor jet, in 600 liters of water at 20° C., with the addition of 1.5 kg of the polypropylene oxide adduct prepared according to Method A. 300 g of a direct dye of the formula

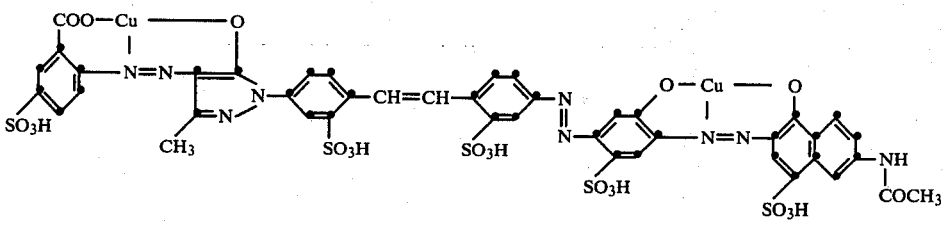

(106)

are then added to the liquor. The dye liquor is heated to 90° C. in the course of 30 minutes and the goods are dyed for 10 minutes at this temperature. 5 kg of Glauber salt are then added in 3 portions, at 5 minute intervals, to the dye liquor. After the final addition of the salt, the temperature is raised to 96° C. and the goods are dyed for a further 20 minutes at this temperature. The liquor is then cooled and the dyed goods are rinsed and dried. A pale olive dyeing of excellent levelness is obtained.

When the same dyeing procedure is repeated, but without the addition of the product prepared according to Method A, the dyeing is distinctly less level.

In place of the product prepared according to Method A, the same amount, in each case, of one of the carboxyl group-containing polypropylene oxide adducts prepared according to Methods B to E can be used in Examples 1 to 6 with equal success.

What we claim is:

1. A process for dyeing pre-cleaned cellulose fibre material with vat dyes or anionic dyes, which comprises dyeing the cellulose material in the presence of a polypropylene oxide adduct, or a salt thereof, which adduct contains carboxyl groups and has been prepared from a mol ratio of (a) about 1 mol of an aliphatic diol which has an average molecular weight of not more than 2,600;

(b) about 2 mols of an aliphatic dicarboxylic acid, or its anhydride, having 4 to 10 carbon atoms;

(c) about 1 mol of an adduct of propylene oxide with an aliphatic alcohol which is at least trihydric and has 3 to 10 carbon atoms; and (d) about 1 to 2 mols of a fatty acid having 8 to 22 carbon atoms.

2. A process according to claim 1, wherein component (a) is a diol of the formula $$OH\text{-}(CH_2CH_2O)_n\text{-}H \quad (1)$$

in which n is 1 to 50.

3. A process according to claim 2, wherein the diol is a polyethylene glycol with an average molecular weight of 650 to 1,800.

4. A process according to claim 1, wherein component (b) is a saturated or ethylenically unsaturated dicarboxylic acid having 4 to 10 carbon atoms, or the anhydride thereof.

5. A process according to claim 4, wherein component (b) is maleic anhydride.

6. A process according to claim 1, wherein component (c) is an adduct of propylene oxide with a trihydric to hexahydric alkanol having 3 to 6 carbon atoms.

7. A process according to claim 6, wherein the trihydric to hexahydric alkanol is glycerol, trimethylolpropane, erythritol, pentaerythritol, mannitol or sorbitol.

8. A process according to claim 6, wherein component (c) is an adduct having a mol ratio of 4 to 8 mols of propylene oxide with 1 mol of pentaerythritol.

9. A process according to claim 1, wherein component (d) is coconut fatty acid, oleic acid, tallow fatty acid, palmitic acid or stearic acid.

10. A process according to claim 1, wherein the adduct has been prepared from ($a_1$) an aliphatic diol of the formula $$HO\text{-}(CH_2CH_2O)_{n_1}\text{-}H \quad (2)$$

in which $n_1$ is 10 to 40, ($b_1$) a saturated or ethylenically unsaturated aliphatic dicarboxylic acid, or its anhydride, having 4 to 10 carbon atoms, ($c_1$) an adduct of propylene oxide with a trihydric to hexahydric alkanol having 3 to 6 carbon atoms, and ($d_1$) a saturated or unsaturated fatty acid having 12 to 22 carbon atoms.

11. A process according to claim 10, wherein the adduct has been prepared from a mol ratio 1 mol of the condensation product of 1 mol of pentaerythritol and 4 to 8 mols of propylene oxide, 2 mols of maleic anhydride, 1 mol of polyethylene glycol with an average molecular weight of 1,500 and 1 mol of stearic acid.

12. A process according to claim 1, wherein the dyeing is carried out by the exhaustion process.

13. A process according to claim 1, wherein 0.05 to 3 g of the polypropylene oxide adduct are used per liter of dye liquor, based on the solids content of the adduct.

14. A process according to claim 1, wherein the dyeing is carried out with substantive dyes, leuco vat esters, vat dyes or reactive dyes.

15. An aqueous dye liquor for dyeing cellulose fibre material, which comprises at least one vat dye or anionic dye and a carboxyl group-containing polypropylene oxide adduct, or a salt thereof, as defined in claim 1.

* * * * *